United States Patent [19]

Jenkins, Jr. et al.

[11] Patent Number: 4,713,087

[45] Date of Patent: Dec. 15, 1987

[54] CARRIER COMPOSITION FOR INTRODUCING ADDITIVES TO A MOTOR FUEL

[75] Inventors: Robert H. Jenkins, Jr., Walden; Edward Mitchell, Hopewell Junction; Frank J. Gaetani, Poughkeepsie; John J. Mahusky, Marlboro; Marilyn Hall, Poughkeepsie, all of N.Y.

[73] Assignee: Texaco Inc., White Plains, N.Y.

[21] Appl. No.: 918,205

[22] Filed: Oct. 14, 1986

[51] Int. Cl.[4] ..... C10L 1/16; C10L 1/18

[52] U.S. Cl. ..... 44/53; 44/56

[58] Field of Search ..... 44/53, 56

[56] References Cited

U.S. PATENT DOCUMENTS

| | | | |
|---|---|---|---|
| 4,541,836 | 9/1985 | Derderian | 44/56 |

FOREIGN PATENT DOCUMENTS

| | | | |
|---|---|---|---|
| 0049921 | 4/1982 | European Pat. Off. | 44/53 |
| 0117915 | 9/1984 | European Pat. Off. | 44/53 |
| 0146907 | 7/1985 | European Pat. Off. | 44/53 |
| 3330165 | 3/1985 | Fed. Rep. of Germany | 44/53 |
| 7413839 | 1/1975 | Netherlands | 44/53 |

*Primary Examiner*—William R. Dixon, Jr.
*Assistant Examiner*—Jerry D. Johnson
*Attorney, Agent, or Firm*—Robert A. Kulason; James J. O'Loughlin; Robert B. Burns

[57] ABSTRACT

A novel diluent composition for handling fuel additives comprising a mixture of hydrocarbons in the avjet boiling range in combination with primary amyl alcohol.

8 Claims, No Drawings

CARRIER COMPOSITION FOR INTRODUCING ADDITIVES TO A MOTOR FUEL

BACKGROUND OF THE INVENTION

Field of the Invention

This invention relates to motor fuel compositions and, more particularly, to a diluent or carrier composition useful for introducing or blending concentrates of motor fuel additives into a base motor fuel composition.

Substantial volumes of base gasoline, i.e., the motor fuel base prior to the addition of the full complement of additives necessary to produce a fully formulated finished gasoline composition, are transported via common carriers to numerous distribution terminals throughout the country. It is conventional to blend the required additive package into the base gasoline at the distribution terminal prior to delivery of the finished fully formulated motor fuel composition to the market outlets. For purposes of standardization and quality control, a concentrated package of the motor fuel additive is usually prepared at a small number of locations and this concentrate is shipped to the various distribution terminals for blending into the base fuel composition.

Problems were encountered when new motor fuel concentrates were employed in the manufacture of finished gasoline. Initially, it was found that conventional solvents or diluents were not satisfactory for completely dissolving the additive concentrate resulting in a hazy appearing mixture. It further developed that under cold weather conditions, the additive precipitated from the concentrate additive package with the result that insufficient additive was added to the base gasoline being treated. Moreover, additive concentrate packages based on conventional practices become too viscous at low temperatures, i.e. temperatures below 0° F. as for example −20° F. and −30° F. The viscous motor fuel additive concentrate package caused cavitation in the delivery system pumps leading to severe mechanical damage to the pumps and breakdown of the delivery system.

Safe handling of the additive concentrate package during transit in common carriers and during handling at the blending and distribution terminal make the requirement of a high flash point critical for the additive concentrate package. In general, conventional solvents and additive handling procedures have been found wanting or ineffective for preparing an additive concentrate package that meets the high flash point criteria and at the same time insures the stability and low viscosity of the additive concentrate package.

A novel diluent composition has now been discovered which substantially removes or overcomes the problems noted.

SUMMARY OF THE INVENTION

The novel diluent composition of the invention comprises a mixture of hydrocarbons in the avjet boiling range in combination with primary amyl alcohol. More specifically, the diluent composition of the invention comprises from about 3 to 6 parts by weight of a mixture of hydrocarbons in the avjet boiling range per one part by weight of primary amyl alcohol.

DETAILED DESCRIPTION OF THE INVENTION

The novel diluent composition of the invention comprises from about 3 to 6 parts by weight of a mixture of hydrocarbons boiling in the avjet boiling range per one part by weight of primary amyl alcohol.

Suitable mixtures of hydrocarbons in the avjet boiling range broadly encompasses such a mixture boiling from about 285° to 575° F. Preferably, the avjet mixture of hydrocarbons will boil in the range from about 320° to 520° F. A highly effective and most preferred avjet mixture boils in the range from about 335° to 510° F.

The second component of the diluent composition is primary amyl alcohol. Primary amyl alcohol is provided commercially as a mixture of primary amyl alcohols. Such a mixture will generally comprise 1-pentanol, 3-methyl-1-butanol, 2-methyl-1-butanol and 2,2-dimethylpropanol. The term primary amyl alcohol is intended herein and in the claims to encompass and include all of the isomeric primary amyl alcohol species and mixtures thereof. The use of an isomeric mixture of primary amyl alcohols in the diluent composition is considered to be very important for preparing and insuring the satisfactory performance of the additive concentrate package. It is postulated that the isomeric mixture of primary amyl alcohols contributes substantially to the additive solubility properties of the diluent composition of the invention. Minor amounts of other aliphatic alcohols may also be present in the primary amyl alcohol mixture so long as such amounts do not significantly reduce the effectiveness of the primary amyl alcohol or of the diluent composition.

In general, from about 3 to 6 parts by weight of the avjet mixture and one part by weight of the primary amyl alcohol are employed to make the diluent composition. A preferred ratio for the diluent composition is from about 4 to 6 parts of the avjet mixture of hydrocarbons to one part of primary amyl alcohol. The most preferred ratio for the diluent composition is 5 parts by weight of the avjet mixture and 1 part by weight of primary amyl alcohol.

The diluent composition of the invention is used to prepare a motor fuel additive concentrate package containing one or more motor fuel or gasoline additives suitable for mixing and blending in a base motor fuel. As indicated above, the motor fuel additive concentrate package must be formulated to insure good solubility of the additives present even at low temperatures, and low viscosity of the mixture at low temperature to insure ease of transport and, more importantly, good deliverability and mixing properties when introduced into the base fuel via conventional injection or blending equipment. Finally, the motor fuel additive concentrate must have a flash point of at least 100° F. as a safety measure during shipping and handling.

Motor fuel or gasoline additives which can be employed with the diluent composition of the invention to provide a motor fuel additive concentrate package include conventional detergents, anti-knock additives, corrosion inhibitors, anti-oxidants, dyes and the like. In general, the motor fuel additive concentrate may contain one or more of the noted gasoline additives. In common practice, the base gasoline or motor fuel may contain one or more additives, such as a corrosion inhibitor or an anti-oxidant introduced at the refinery. To formulate a finished gasoline or motor fuel composition, additional additives, often proprietary additives including carburetor and injector detergents, deposit inhibitors, ORI improving additives and the like must be added to the base gasoline at the distribution terminal. This practice not only provides standardization and quality control, it also effects blending of the essential additive components in the fuel composition at a point close to the point of consumption serving to insure optimum effectiveness of the injected additives during the critical consumption period.

The motor fuel additive concentrate is prepared by mixing the desired additive or mixture of additives with the diluent composition. In general, the motor fuel additive concentrate will contain from about 5 to 25 weight percent of the additive or additive mixture and the balance, 75 to 95 weight percent, of the novel diluent composition. Preferably, the fuel additives will amount to from about 10 to 20 weight percent, with the balance being the diluent composition.

The motor fuel additive concentrate prepared from a blend or mixture of gasoline additives and the diluent composition of the invention will have a minimum flash point of 100° F., will have a low viscosity and will effectively deliver the essential fuel additives in the motor fuel additive concentrate to a base motor fuel composition using a conventional delivery system at sub-zero temperatures.

The following specific example illustrates the practice of this invention.

EXAMPLE 1

A motor fuel additive concentrate solution was prepared containing 15 weight percent of a commercial fuel detergent additive. This additive concentrate solution had the following composition:

| | Wt. % |
|---|---|
| Avjet hydrocarbons: Boiling range 334 to 508° F. | 70.5 |
| Primary amyl alcohol | 14.5 |
| Commercial detergent[1] | 15.0 |

[1]Detergent of the type disclosed in U.S. Pat. No. 3,773,479

This additive concentrate had a flash point of 111° F. and maintained a low viscosity and solution stability at a temperature of −40° F.

The additive concentrate based on the novel diluent composition of the invention was found to be effective as a motor fuel additive diluent and carrier and to effect the blending of motor fuel additives into base fuel compositions at surprisingly low temperatures.

We claim:

1. A diluent composition effective for solubilizing a motor fuel additive to form a motor fuel additive concentrate solution, said solution being characterized by having a relatively high flash point, a low viscosity and solution stability at temperatures below 0° F., said diluent composition comprising a mixture of hydrocarbons in the avjet boiling range and primary amyl alcohol in the proportion of from 3–6 parts by weight of said mixture of hydrocarbons per part by weight of said primary amyl alcohol.

2. A composition according to claim 1 in which said motor fuel additive concentrate solution has a minimum flash point of 100° F. and a low viscosity stable solution at a temperature below −10° F.

3. A diluent composition according to claim 1 comprising from about 4–6 parts by weight of said mixture of hydrocarbons per part by weight of said primary amyl alcohol.

4. A motor fuel additive concentrate solution comprising from about 5 to 25 weight percent of a motor fuel additive and from about 95 to 75 weight percent of the diluent composition of claim 1.

5. A motor fuel additive concentrate solution according to claim 4 which said solution comprises from about 10–20 weight percent of a motor fuel additive.

6. A diluent composition according to claim 1 in which said mixture of hydrocarbons boils in range from about 285° to 575° C.

7. A diluent composition according to claim 1 in which said avjet mixture of hydrocarbons boils in the range from about 320° to 520° F.

8. A diluent composition according to claim 1 in which said primary amyl alcohol comprises an alcohol from the group consisting of 1-pentanol, 3-methyl-1-butanol, 2-methyl-1-butanol and 2,2-dimethylpropanol.

* * * * *